US010731230B2

(12) United States Patent
Lourenço

(10) Patent No.: US 10,731,230 B2
(45) **Date of Patent: *Aug. 4, 2020**

(54) TANNING PROCESS FOR OBTAINING LEATHER

(71) Applicant: TECHPOLYMERS INDUSTRIA E COMERCIO Ltda, Sao Bernardo do Campo-SP (BR)

(72) Inventor: Wagner Célio Ferraz Lourenço, Paulinia (BR)

(73) Assignee: TECHPOLYMERS INDUSTRIA E COMERCIO Ltda, Sao Bernardo do Campo (BR)

( * ) Notice: Subject to any disclaimer, the term of this patent is extended or adjusted under 35 U.S.C. 154(b) by 0 days.

This patent is subject to a terminal disclaimer.

(21) Appl. No.: 15/025,854

(22) PCT Filed: Sep. 30, 2014

(86) PCT No.: PCT/IB2014/001956
§ 371 (c)(1),
(2) Date: Mar. 29, 2016

(87) PCT Pub. No.: WO2015/044765
PCT Pub. Date: Apr. 2, 2015

(65) Prior Publication Data

US 2016/0244854 A1 Aug. 25, 2016

(30) Foreign Application Priority Data

Sep. 30, 2013 (EP) ..... 13186726

(51) Int. Cl.
*C14C 3/06* (2006.01)
*C14C 1/08* (2006.01)

(52) U.S. Cl.
CPC . *C14C 3/06* (2013.01); *C14C 1/08* (2013.01)

(58) Field of Classification Search
CPC ..... C14C 3/02; C14C 3/06
See application file for complete search history.

(56) References Cited

U.S. PATENT DOCUMENTS 2,696,996 A * 12/1954 Engelhardt ..... F16B 2/065
403/391
3,996,292 A * 12/1976 Decor ..... C07C 45/41
568/490

(Continued)

FOREIGN PATENT DOCUMENTS

BR 9603419-0 A 6/1998
BR 9702025-7 A 6/1998

(Continued)

OTHER PUBLICATIONS

Office Action dated Apr. 1, 2019, issued by the India Patent Office in related Indian Patent Application No. 01647014291, with partial English translation (5 pages).

*Primary Examiner* — Vasudevan S Jagannathan
*Assistant Examiner* — Preeti Kumar
(74) *Attorney, Agent, or Firm* — Osha Liang LLP

(57) ABSTRACT

The invention concerns a process for tanning hide to obtain leather. The general process for obtaining the intermediary wet blue stage comprises the following steps: a) a picking step with acid and salt, followed by b) a tanning step with chromium salt, followed by c) a basification step. The invention is characterized in that the bath of the pickling step comprises organic acids selected from 2-Methyl glutaric acid (MGA), ethyl succinic acid (ESA) and mixture thereof instead of the traditional strong acid, generally sulfuric acid This process requires less basification agent and enables an increase of the up-taking of the re-tanning products. This invention provides leather with improved mechanical properties.

13 Claims, 2 Drawing Sheets

(56) References Cited

U.S. PATENT DOCUMENTS

Figure 1A:
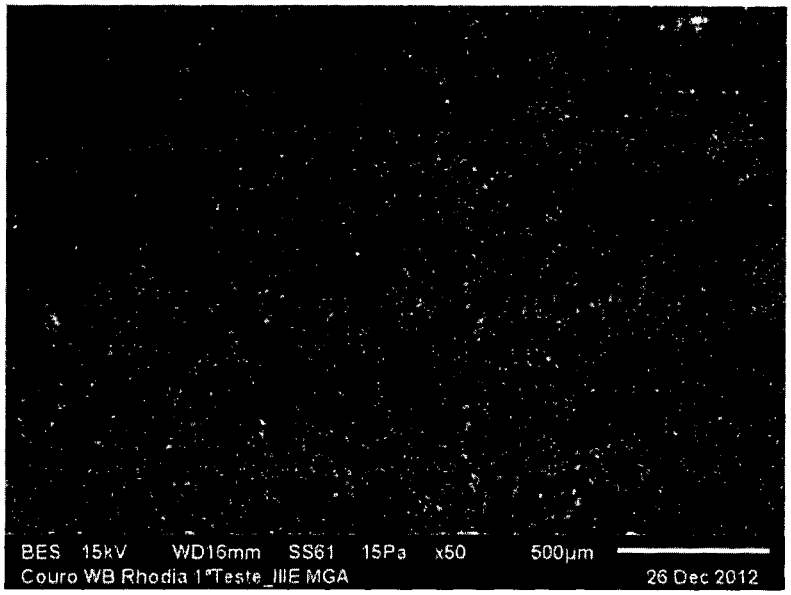

| | | | | | |
|---|---|---|---|---|---|
| 4,042,321 | A | | 8/1977 | Backer et al. | |
| 4,101,271 | A | * | 7/1978 | Bockelman | C14C 3/06 8/94.26 |
| 4,187,074 | A | * | 2/1980 | Traubel | C08G 18/0814 521/158 |
| 4,715,861 | A | | 12/1987 | Lotz et al. | |
| 4,938,779 | A | * | 7/1990 | Friese | C14C 3/06 8/94.19 R |
| 4,978,361 | A | | 12/1990 | Fuchs et al. | |
| 5,885,302 | A | | 3/1999 | Leuck | |
| 2005/0268671 | A1 | * | 12/2005 | Lourenco | C14C 3/06 69/21 |
| 2009/0172890 | A1 | * | 7/2009 | Huffer | C14C 3/16 8/94.17 |
| 2010/0119775 | A1 | * | 5/2010 | Bustos | C08G 18/0823 428/151 |

FOREIGN PATENT DOCUMENTS

| | | | | | |
|---|---|---|---|---|---|
| EP | 0270767 | A1 | | 6/1988 | |
| EP | 822263 | B1 | | 10/1999 | |
| RU | 2126839 | C1 | | 2/1999 | |
| WO | WO 9606878 | A1 | * | 3/1996 | A61Q 17/04 |
| WO | 2004015148 | A1 | | 2/2004 | |
| WO | WO 2004015148 | A1 | * | 2/2004 | C14C 3/06 |

* cited by examiner

TANNING PROCESS FOR OBTAINING LEATHER

This application is a U.S. national stage entry under 35 U.S.C. § 371 of International Application No. PCT/IB2014/001956, filed Sep. 30, 2014, which claims priority to Application No. EP 13186726.9 filed on Sep. 30, 2013. The entire content of each of these applications is hereby incorporated herein by reference.

The present invention is related to a process of tanning hides to obtain leather. More specifically, it refers to an improvement introduced in the conventional process of tanning hide with chrome to obtain better quality leather. The advantages of the present invention are obtained with smooth acidification with organic acid in the pickling step.

STATE OF THE ART

Hide tanning is a process in which the collagen protein present therein reacts with tanning agents, originating leather—the tanning process is therefore one of the essential steps in leather production process. It is a very old process, whose purpose is to avoid hide degradation and putrefaction, by means of a protein crosslinking phenomenon caused by the action of the employed tanning agent.

For chrome tanning producing "Wet Blue" (an intermediary stage prior to obtaining the final leather), traditionally used tanning agents are chrome III salts, such as chrome sulfate or basic chrome sulfate. Typically, leather has already been tanned when the hide incorporates about 3.5% by weight of chrome oxide, $Cr_2O_3$, dry basis, thus obtaining retraction test resistant leathers.

In the traditional processes of tanning hide, only 70% to 80% of chrome oxide available in the tanning bath is used. This means that the use of a large excess of salt is required, imposing additional costs to the process and generating an undesirable residue, potentially causing damaging impact to the environment and requiring storage and/or chemical treatment before disposal.

Despite the fact that chrome III compounds are not damaging to plants and animals, especially under neutral conditions, international rules impose low limits to the presence of chrome III and other heavy metals in water and air.

U.S. Pat. Nos. 4,715,861 and 4,978,361 describe better hide absorption of chrome by hide by means of supplementary addition of chemical compounds. U.S. Pat. No. 4,042,321 proposes recycling the tanning bath by a complex and costly process aiming the reduction of effluents treatment, being, however, complicated due to the accumulation of salts and fiber residues. European patents EP 822,263 and Brazilian patents BR 9603419-0 and BR 9702025-7 disclose larger exhaustion of the chrome bath by the use of aldehyde, which is very toxic. As a rule, the state of the art always proposes more steps and/or the use of more raw materials to deal with the problem.

The traditional Chromium process from the animal hide to the final leather comprises the following step:

1) Liming, unhairing and fleshing the animal hide
2) Deliming and bating the hide obtained after step 1 generally with the use of ammonium salt and deliming agents
3) Pickling step: the hide is subjected to an acidification step in a bath comprising also a salt, usually sodium chloride
4) Tanning step: chromium salt is added in the bath during a time sufficient to enable the chromium ion to cross the hide cross-section 5) Basification step: a basifying agent is added in the bath which is then heated
6) After draining and washing a wet blue leather is obtained
7) Re-tanning step
8) Finishing steps (neutralization, dyeing, fixation, fatliquoring)
9) Obtaining the crust leather
10) Additional finishing steps
11) Obtaining final leather.

It is additionally verified that proposed solutions generally assume that hide tanning is achieved according to a little elucidated process, according to which (1) chrome salt is firstly introduced in the hide under pH between 2.5 and 3, in the presence of sodium chloride in the tanning bath, when the affinity of chrome salts and terminal carboxylic groups of collagen (protein) is minimum, avoiding the precipitation and staining of the hide (stage known as pickling); (2) followed by fixing chrome to the hide, raising pH to between 3.8 and 4.2, causing the reaction between the terminal carboxylic groups of the protein and chrome salts (stage known as basification). In this conventional process, the low pH of the bath (2.5 to 3), considered an essential requirement, is usually reached by the addition of organic acids until pH between 4 and 6, followed by the addition of strong acids such as sulfuric or hydrochloric acid until pH between 2.5 and 3.

The basification step, as currently used, requires careful controls, since the speed or excessive amount in the addition of the basifying agent may cause stains in the leather, being therefore a step to be performed with care and attention.

In 2002, the Applicant found that enough chrome can be fixed to the hide in a tanning process, similar to the traditional one, but using less acid pH range than that used until the moment. WO 2004/015148 discloses a tanning process in which the acidification is carried out with organic acids such as glutaric, adipic and succinic acids without any strong acid such as sulfuric acid. The pickling bath reached pH of 3.5 to 5. Some advantages of this innovation are the following: —the use of strong acids, such as sulfuric or hydrochloric acid, is fully excluded from the tanning process, making it safer from the operators' health point of view; —the chrome salt in the tanning bath is more efficiently used, and the quantity of offered chrome salt can be reduced with relation to the excess needed in the traditional process, reducing its costs; —the use of lower quantities of salt, sodium chloride, or even its full exclusion is possible; —less potentially harmful to nature residues are generated; —the generation of less polluting residues requires less treatment than needed in traditional process; —the basification step is excluded, whose purpose was to raise the pH of the tanning bath to fix the chrome to the protein; —it allows the tanning bath to be recycled; —the total time to process the hide to obtain leather is reduced.

BRIEF DESCRIPTION OF THE INVENTION

The applicant now is willing to improve further the advantages of a tanning process with smooth acidification in the pickling step. In particular, the applicant is willing to improve the mechanical properties of the leather. The inventor has now found that a better Tensile Strength can be obtain when using a different organic acid in the pickling step while keeping all the advantages of his former invention with regards the traditional process with strong acid.

The object of the present invention is a process of tanning hides comprising:

1. a pickling step consisting of immerging the hides in a bath with acid and salt, followed by
2. a tanning step consisting of immerging the hides in a bath with chromium salt, followed by
3. a basification step consisting of immerging the hides in a bath with a basifying agent; the process of the invention being characterized in that the bath of the pickling step comprises organic acids selected from 2-Methyl glutaric acid (MGA), ethyl succinic acid (ESA) and mixture thereof.

Advantageous characteristics of the process can be found in the sub-claims and below.

DETAILED DESCRIPTION OF THE INVENTION

In the process according to the invention, the amount of organic acids in the bath of the pickling step is advantageously comprised between 0.25 to 10%, preferably from 0.5 to 5% of the weight of the hides.

In one particular embodiment of the invention, the organic acids further comprise Adipic Acid (AA).

In the process according to the invention, the organic acids preferably comprise:

between 70 and 100 weight % of MGA;
between 0 and 30 weight % of ESA;
between 0 and 15 weight % of AA.

More particularly, the organic acids can comprise:

between 80 and 95 weight % of MGA;
between 0 and 10 weight % of ESA;
between 5 and 10 weight % of AA.

According to the invention, the bath of the pickling step can further comprise, with relation to the hide weight, between 2.5 and 10 weight % of a salt, in particular sodium chloride.

It can also be preferred that the bath of the pickling step further comprises with relation to the hide weight, between 0.4 and 2 weight % of formic acid.

In some embodiments, the bath of the pickling step further comprises a bleaching agent.

According to the process of the invention, the pH of the bath of the pickling step is advantageously comprised between 3.0 and 5.0, and more preferably between 3.4 and 4.0.

The process according to the invention can also be characterized in that the amount of basifying agent used in the basification step is comprised between 0.20 and 0.45%, preferably between 0.3 and 0.4% with relation to the weight hide.

EXAMPLES

Examples 1 to 3

Production of the Wet Blue Intermediary Stage

Example 1

200 kg of hide for which liming, unhairing and fleshing process are completed is washed in the tanning drum with the same weight of water for 10 minutes.

For all examples, all ingredients added thereafter are weight percentage of the initial hide weight.

After the washing the water bath is discharged and the hides are submitted to deliming and bating with the use of 1.8% of ammonium sulfate and 1% of a commercial deliming agent based on di-carboxylic acids (Ex: Rhodiaeco Descal SD commercialized by Rhodia Poliamida e Especialidades Ltda.). After all, bating process takes place, adding 0.08% of a standard commercial proteolytic enzyme (run 60 minutes), (pH=8.0). At the end of these operations the cross-section of the hide does not show a pink color with phenolphthalein indicator.

The hides are washed twice with 100% of water, based on pelt weight, and the washings are discharged.

Pickling Step:

With relation to the hide weight, 40% of water is added followed by 5% of sodium chloride (Bé (Baumé scale) 6 to 7) (run 15 minutes), 0.4% of a commercial bleaching (run for 15 minutes). After this time, 0.8% of 85% formic acid diluted in water (1 to 10) is added into the drum (run 30 minutes) followed by the addition of 0.75% of a mixture of 2-Methyl glutaric acid (MGA), ethyl succinic acid (ESA) and adipic acid (AA) diluted in water (1 to 3) and the drum is run for an additional 15 minutes. After this time the pH of the bath is around 3.5.

Tanning Step:

At this point, 3% of commercial chromium sulphate salt (ex: basic chromium sulphate, which presents 33% alkalinity and 25 to 26% chrome HI oxide) is added (run for 60 minutes). A second addition of 3% of chromium sulphate salt is added and the drum is run for additional 6 hours after which time the chromium has completely crossed the hide cross-section.

Basifyinq Step:

After this time, 20% of water is added followed by 0.35% of a commercial basifying agent (ex: magnesium oxide) (run 90 minutes). The water bath is heated from 35° C. to 50° C. during 5 hours, the drum is drained, the wet blue is washed with 100% of water (based on pelt weight), drained and washed again with 80% of water.

The obtained Wet Blue is submitted to the analysis of the total chromium content, chromium in layers and evaluation by Scanning Electron Microscope (EDS) (Table 1 and FIG. 1*a*).

Example 2

1000 kg of hide for which liming, unhairing and fleshing process are completed is washed in the tanning drum with 100% of water (based on pelt weight) for 10 minutes. After that, the hides are submitted to deliming and batting according to example 1.

With relation to the hide weight, 40% of water and 5% of sodium chloride (Bé 6 to 7) are added into the drum (run for 15 minutes), followed by 0.4% of a commercial bleaching (run 15 minutes). After this time, 0.8% of 85% formic acid diluted in water (1 to 10) is added (run 30 minutes) followed by the addition of 2.5% of an aqueous solution of a mixture of 2-Methyl glutaric acid (MGA), ethyl succinic acid (ESA) and adipic acid (AA) and the drum is run for an additional 15 minutes. After this time the pH of the bath is around 3.5.

At this point a 3% of commercial chromium sulphate salt (ex: basic chromium sulphate, which presents 33% alkalinity and 25 to 26% chrome III oxide) is added (run 60 minutes). A second addition of 3% of chromium sulphate salt is added and the drum is run for an additional 6 hours, after which time the chromium has completely crossed the hide cross-section.

After this time, 20% of water is added and 0.35% of a commercial basifying agent (ex: magnesium oxide) is added into the drum (run 90 minutes). The water bath is heated from 35° C. to 50° C. during 5 hours, the drum is drained, the wet blue is washed with 100% of water (based on pelt weight), drained and washed again with 80% of water.

Example 3

Comparative Example; Traditional Process with Strong Acidification 200 kg of hide for which liming, unhairing and fleshing process are completed is washed in the tanning drum with 100% of water (based on pelt weight) for 10 minutes. After that, the hides are submitted to deliming and batting according to example 1.

With relation to the hide weight, 40% of water, 6% of sodium chloride (Bé 6 to 7) (run 15 minutes), 0.4% of a commercial bleaching are added into the drum (run 15 minutes). 0.6% of 85% formic acid diluted in water (1 to 10) is added into the drum (run 30 minutes) followed by the addition of 0.3% of sulfuric acid diluted in water (1 to 15)(run 15 minutes), 0.3% of sulfuric acid diluted in water (1 to 15)(run 15 minutes) and 0.4% of sulfuric acid diluted in water (1 to 15) (run 3 hours). After this time the pH of the bath is around 2.5 to 3.

At this point 3% of commercial chromium sulphate salt (ex: basic chromium sulphate, which presents 33% alkalinity and 25 to 26% chrome III oxide) is added into the drum (run for 60 minutes). A second addition of 3% of chromium sulphate salt is added and the drum is run for additional 3 hours after which time the chromium has completely crossed the hide cross-section.

After this time, 20% of water is added followed by 0.35% of a commercial basifying agent (ex: magnesium oxide) (run 90 minutes). A second portion of 0.15% magnesium oxide is added and the drum is run for an additional 90 minutes. The water bath is heated from 35° C. to 50° C. during 5 hours, the drum is drained, the wet blue is washed with 100% of water (based on pelt weight), drained and washed again with 80% of water.

Figure 1B:
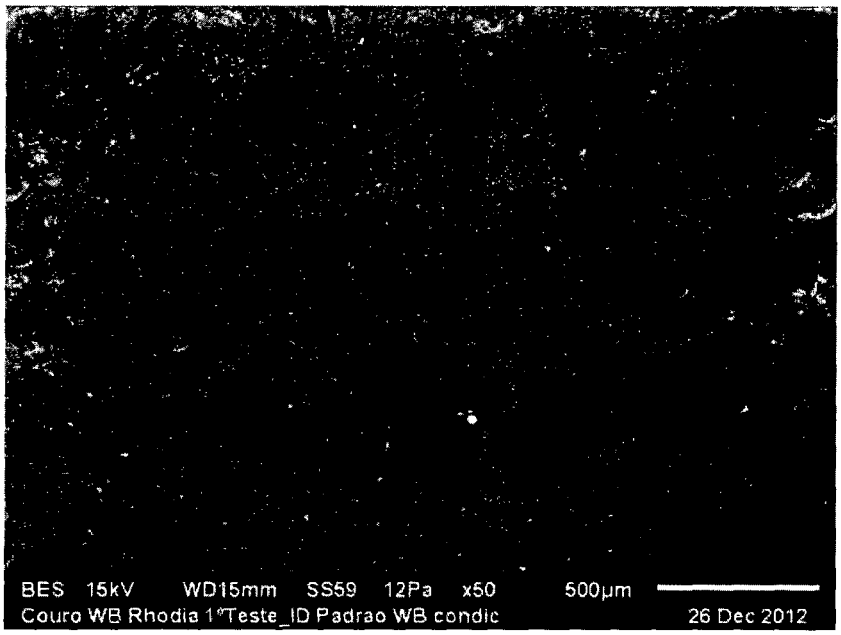

The obtained Wet Blue was submitted to the analysis of the total chromium content, chromium in layers and evaluation by Scanning Electron Microscope (EDS) (Table 1 and FIG. 1*b*).

Example 4

Production of the Retanned Hides (Crust Step) of Examples 1 to 3

The Wet Blue obtained in the examples 1 and 3 are identified by different marks, combined and submitted to a standard re-tanning process. The marked Wet Blue hides are placed in the drum, and washed with 200% of water at 30° C. (based on Wet Blue weight) for 30 minutes and the washing is drained.

150% of water, 2% of sodium formiate and 0.3% of sodium bicarbonate are added into the drum and run for 60 minutes after which time the water bath showed a pH=4.4.

The water bath is drained and 60% of water at 30° C., 2% of a commercial polyacrylate (powder) (run 60 minutes) and the water bath is drained.

150% of water at 60° C., 2% of commercial sulfited synthetic oil, 2% of commercial sulfated emulsified vegetal oil are added, the drum is run for 45 minutes and the water bath is drained.

0.3% of 85% formic acid diluted in water (1 to 5) is added (run 20 minutes), the water bath is drained and the re-tanned hides are washed.

The re-tanned hides are left standing for 12 hours, stretched, naturally dried and softened.

Figure 2A:
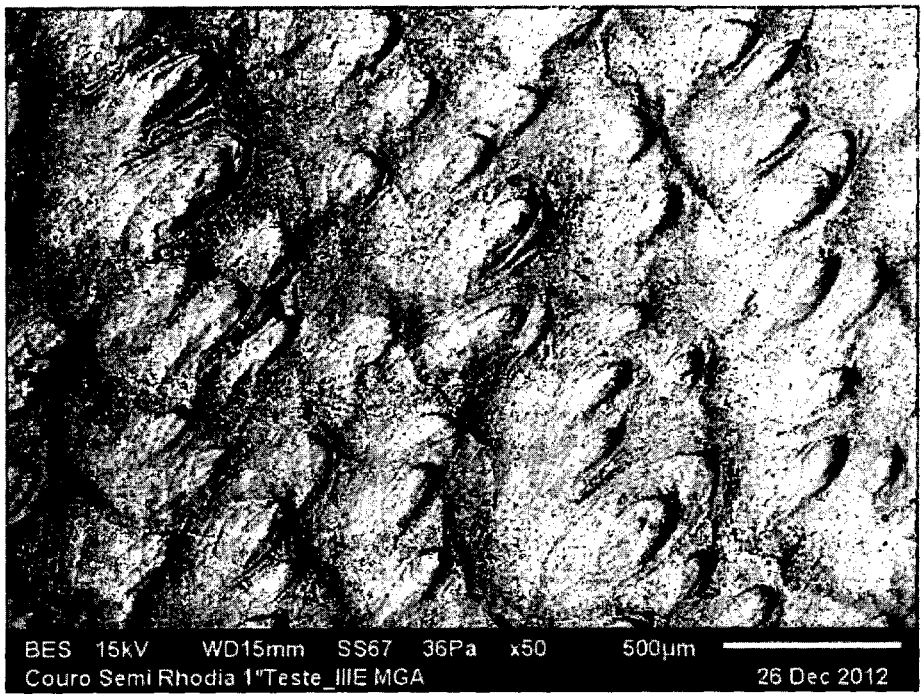
Figure 2B:
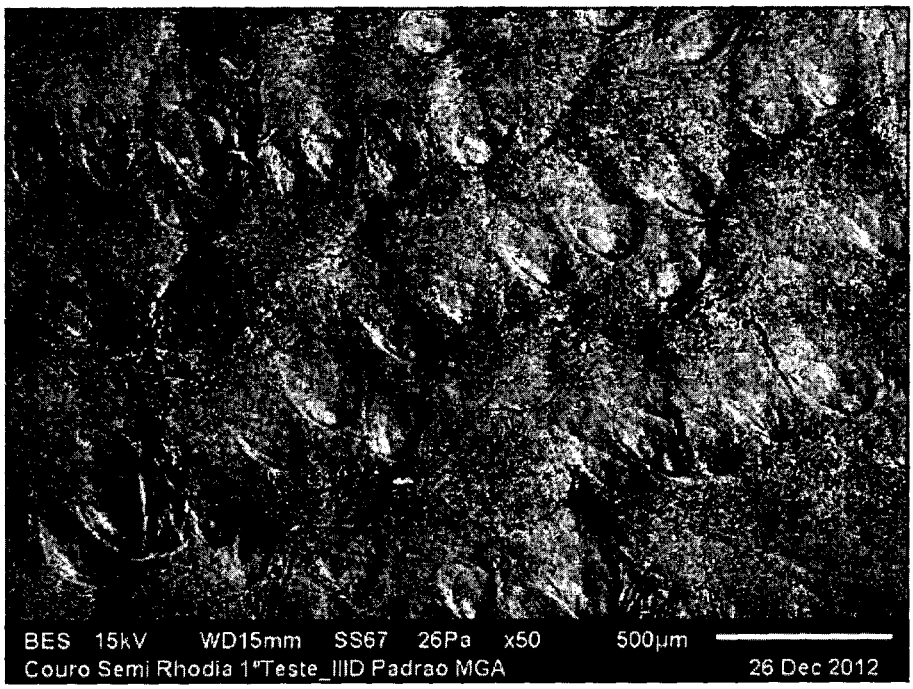

The properties of the re-tanned hides are evaluated and compared concerning tensile strength, breaking strength, tear strength, progressive tensile strength, up-taking of re-tanning products based on a square foot weight of crust, light fastness, color appearance and comparative evaluation by Scanning Electron Microscope (EDS). (Tables 2 to 4 and FIGS. 2*a* and 2*b*).

Examples 5 and 6

Production of the Wet Blue Intermediary Stage

Example 5

Comparative Example According to WO 2004/015148

500 kg of hide for which liming, unhairing and fleshing process are completed is washed in the tanning drum with 100% of water (based on pelt weight) for 10 minutes. After that, the hides are submitted to deliming and batting according to example 1.

With relation to the hide weight, 40% of water, 5% of sodium chloride (Bé 6 to 7) (run 15 minutes) followed by the addition of 0.4% of a commercial bleaching (run for 15 minutes). 0.8% of 85% formic acid diluted in water (1 to 10) is added (run 30 minutes) followed by the addition of 0.75% of Dioro (commercial product from Rhodia Poliamida e Especialidades Ltda based on a mixture of di-carboxylic acids) and the drum is run for 15 minutes. After this time the pH of the bath is around 3.4 to 3.6.

At this point a 3% of commercial chromium sulphate salt (ex: basic chromium sulphate, which presents 33% alkalinity and 25 to 26% chrome III oxide) is added (run 60 minutes). A second addition of 3% of chromium sulphate salt is added and the drum is run for an additional 6 hours after which time the chromium has completely crossed the hide cross-section.

After this time, 20% of water is added and 0.35% of a commercial basifying agent (ex: magnesium oxide) and the drum is run for 90 minutes. The water bath is heated from 35° C. to 50° C. during 5 hours, the drum is drained, the wet blue is washed with 100% of water (based on pelt weight), drained and washed again with 80% of water.

The obtained Wet Blue was submitted to the analysis of the total chromium content and chromium in layers (Table 1).

Example 6

Comparative Example; Traditional Process with Strong Acidification 500 kg of hide for which liming, unhairing and fleshing process are completed is washed in the tanning drum with 100% of water (based on pelt weight) for 10 minutes. After that, the hides are submitted to deliming and batting according to example 1.

With relation to the hide weight, 40% of water, 5% of sodium chloride (Bé 6 to 7) are added and the drum is run for 15 minutes, followed by the addition of 0.4% of a commercial bleaching (run 15 minutes). 0.6% of 85% formic acid diluted in water (1 to 10) is added (run 30 minutes) followed by the addition of 0.3% of sulfuric acid diluted in water (1 to 15) (run for 15 minutes), 0.3% of sulfuric acid diluted in water (1 to 15) (run for 15 minutes) and 0.4% of sulfuric acid diluted in water (1 to 15) and the drum is run for an additional 2 hours. After this time the pH of the bath is around 2.6 to 3.

At this point a 3% of commercial chromium sulphate salt (ex: basic chromium sulphate, which presents 33% alkalinity and 25 to 26% chrome III oxide) is added (run 60 minutes). A second addition of 3% of chromium sulphate salt is added and the drum is run for an additional 3 hours after which time the chromium has completely crossed the hide cross-section.

After this time, 20% of water is added and 0.35% of a commercial basifying agent (ex: magnesium oxide) (run 90 minutes). A second portion of 0.15% magnesium oxide is added and the drum is run for an additional 90 minutes. The water bath is heated from 35° C. to 50° C. during 5 hours, the drum is drained, the wet blue is washed with 100% of water (based on pelt weight), drained and washed again with 80% of water.

Example 7

Production of the Retanned Hides (Crust Step) of Examples 5 and 6

The Wet Blue obtained in the examples 5 and 6 are identified by different marks and submitted to a standard re-tanning process according to example 4.

Results

The properties of the re-tanned hides are evaluated and compared concerning tensile strength, breaking strength, tear strength, progressive tensile strength, up-taking of re-tanning products based on a square foot weight of crust, light fastness and color (Table 2 to 4).

TABLE 1

Analysis of chromium in the final Wet Blue

| | 3.5% minimum | | |
|---|---|---|---|
| Reference Value | Example 3 | Example 1 | Example 5 |
| Dermis | 5.0 | 5.0 | 5.2 |
| Middle | 3.5 | 4.0 | 3.6 |
| Epidermis | 4.2 | 4.5 | 4.5 |
| Layers Average | 4.2 | 4.5 | 4.5 |

FIG. 1 represent Scanning Electron Microscope (EDS) of Wet Blue samples.

FIG. 1.*a* is a wet blue according to example 1 of the invention

FIG. 1.*b*. is a wet blue according to comparative example 3

TABLE 2

Comparative weight of crust leather

| | Example 1 compared to Example 3 after re-tanning | Example 5 compared to Example 6 after re-tanning |
|---|---|---|
| Crust mass variation (up taking of re-tanning products) | +2.1 g | −0.54 g |
| Percentage Variation | 5% | −1.3% |

TABLE 3

Comparative physical-mechanical properties of crust leather

| | | Measurements | Minimum Values | Example 3 after re-tanning | Example 1 after re-tanning | Example 5 after re-tanning |
|---|---|---|---|---|---|---|
| Tensile Strength IULTCS IUP6/ISO 3376:2011 | Direction A | Breaking Strength (N) | 150 | 156.8 | 133.1 | 149 |
| | | Tension Strength (N/mm2) | 15 to 18 | 12.8 | 10.2 | 12.1 |
| | Direction B | Breaking Strength (N) | | 150.4 | 214.4 | 125.5 |
| | | Tension Strength (N/mm2) | | 14.5 | 17.1 | 10.5 |
| Progressive Tensile Strength IULTCS 8/ISO 3372-2:2002 | | Tear Strength (N) | 50 | 63.2 | 74.7 | 50.6 |
| | | Specific strength (N/mm) | 49.1 | 54.8 | 60.2 | 42.3 |

TABLE 4

Comparative light fastness

| | Example 3 after re-tanning | Example 1 after re-tanning | Example 5 after re-tanning |
|---|---|---|---|
| Light Fastness | 4 | >4 | >4 |

NOTES:
Xenon Lamp (Method EN ISO 105-B02:2002)
Total exposure time: 24 hours, Filter Ultraviolet
Irradiance: 445 W/m$^2$ in 300 to 800 nm
After the test the specimens are kept at least 1 hour in the dark in a conditioned environment at 23 +/− 2° C. and air relative humidity of 50 +/− 5%.

FIG. 2 represent Scanning Electron Microscope (EDS) of Crust samples

FIG. 2.*a* is a crust from wet blue according to example 1 of the invention

FIG. 2.*b* is a crust from wet blue according to comparative example 3

CONCLUSIONS

The use of the organic acids (in particular the mixture of 2-Methyl glutaric acid (MGA), ethyl succinic acid (ESA) and adipic acid (AA)) allows the complete elimination of the sulfuric acid during pickling step. The invention therefore provides a safer process and less risk for the employees.

The invention requires less basifying agent (in particular MgO) in the basification step with regards to the standard process. The impact is economical (less chemicals) and also reduces the process time (economical, save energy).

The wet blue obtained with the invention show a more homogeneous distribution of chromium with regards to the standard process and also with regards to the former process of the inventor. The physical-mechanical properties of crust and final leather are improved as regards the standard process and as regards the previous process of the inventor.

The invention claimed is:

1. A process for tanning hides, comprising:

a) immerging the hides in a bath with acid, salt, and an organic acid mixture, followed by b) immerging the hides in a bath with chromium salt, and subsequently c) immerging the hides in a bath with a basifying agent, wherein the organic acid mixture comprises:

at least 70 weight % of 2-methyl glutaric acid;

greater than 0 and at most 30 weight % of ethyl succinic acid; and between 0 and 15 weight % of adipic acid.

2. The process according to claim 1, wherein the amount of organic acids in the bath of step a) of the process is between 0.25 to 10% based on the weight of the hides.

3. The process according to claim 1, wherein the organic acid further comprises adipic acid.

4. The process according to claim 1, wherein the organic acid is a mixture comprising:

between 80 and 95 weight % of 2-methyl glutaric acid;

greater than 0 and at most 10 weight % of ethyl succinic acid;

between 5 and 10 weight % of adipic acid.

5. The process according to claim 1, wherein the bath of step a) of the process further comprises, based on the weight of the hides, between 2.5 and 10 weight % of the salt.

6. The process according to claim 1, wherein the bath of step a) of the process further comprises based on the weight of the hides, between 0.4 and 2 weight % of formic acid.

7. The process according to claim 1, wherein the bath of step a) of the process further comprises a bleaching agent.

8. The process according to claim 1, wherein the pH of the bath of step a) of the process is between 3.0 and 5.0.

9. The process according to claim 1, wherein the pH of the bath of step a) of the process is between 3.4 and 4.0.

10. The process according to claim 1, wherein the amount of basifying agent used in step c) of the process is between 0.20 and 0.45%, based on the weight of the hides.

11. The process according to claim 2, wherein the amount of organic acids in the bath of step a) of the process is from 0.5 to 5%, based on the weight of the hides.

12. The process according to claim 5, wherein the bath of step a) of the process further comprises between 2.5 and 10 weight % of sodium chloride, based on the weight of the hides.

13. The process according to claim 1, wherein the amount of basifying agent used in step c) of the process is between 0.3 and 0.4%, based on the weight of the hides.

* * * * *